United States Patent [19]

Keller

[11] 4,015,682

[45] Apr. 5, 1977

[54] PROTECTING SYSTEM FOR ROADWAY ADJACENT AREAS

[76] Inventor: Alfred Keller, Hermikonstrasse 25, CH-8600 Dubendorf, Switzerland

[22] Filed: Apr. 14, 1975

[21] Appl. No.: 567,773

Related U.S. Application Data

[63] Continuation of Ser. No. 434,315, Jan. 17, 1974.

[52] U.S. Cl. ..... 181/33 E; 181/33 HE

[51] Int. Cl.² ..... G10K 11/00

[58] Field of Search ..... 181/141, 175, 176, 33 HE, 181/33 E, 35 R, 36 R; 52/144, 145

[56] References Cited

UNITED STATES PATENTS

| | | | |
|---|---|---|---|
| 2,519,162 | 8/1950 | Tucker | 52/144 X |
| 2,685,936 | 8/1954 | Brenneman et al. | 181/33 HE |
| 2,726,830 | 12/1955 | Brown et al. | 181/33 HE |
| 2,730,942 | 1/1956 | Peterson | 52/144 X |
| 3,783,968 | 1/1974 | Derry | 181/33 HE |
| 3,812,931 | 5/1974 | Hauskins | 181/33 E |

OTHER PUBLICATIONS

Harris, C. M., "Handbook of Noise Control," McGraw-Hill Book Co., Inc., New York, 1957, pp. 2-5, 2-6.

Kettinger, M., "Noise Level Reduction of 'Depressed' Freeways," Noise Control, vol. 5, No. 4, July 1959, pp. 12-14, and 54.

*Primary Examiner*—Lawrence R. Franklin

*Attorney, Agent, or Firm*—Lowe, King, Price & Markva

[57] ABSTRACT

A roadway with a noise protecting assembly for controlling sound emanating from the roadway. The assembly comprises a plurality of walls having a width disposed vertically above the roadway and a length disposed in a direction parallel to the center line of the roadway. The walls are laterally spaced with respect to each other across the width of a frame structure thereby forming intervals therebetween. The assembly is effective to prevent the direct path of sound from a source of noise on the roadway to objects in the vicinity of the roadway which is the source of the noise.

18 Claims, 8 Drawing Figures

PROTECTING SYSTEM FOR ROADWAY ADJACENT AREAS

STATUS OF THE APPLICATION

This is a continuation application of my copending application Ser. No. 434,315 filed Jan. 17, 1974.

BACKGROUND OF THE INVENTION

Mechanization and motorization have steadily increased the emission of noise. Consequently, depending upon the time and place, the effects of noise have reached or exceeded tolerable limits. The control or reduction of noise has become an important objective. The most significant sources of noise are traffic on roads, railways, in the air, industry, building, and in sport such as shooting ranges.

It is known to erect protective devices directly at the point of origin for the noise as an effective measure for the reduction of the noise. For example, protective walls or protective mounds may be set up alongside roads. Their effectiveness is conditional and limited. High buildings may be protected only on the lower floors depending upon the distance the buildings are from the road. Noise also passes over the protection devices with the result that only a restricted noise shadow zone exists behind the devices. In certain circumstances, unprotected zones may be subjected to increased noise because of sound reflections. In many cases, however, the protection afforded by using sound absorbing materials is sufficient because a proportion of the noise is destroyed.

Significant or complete protection of the environment against traffic is possible. The road may be laid underground, sunk below the level of the surrounding terrain and covered over, or lined on all sides. The disadvantages of these methods, however, lies in the high construction and operating costs. Artificial ventilation and lights are necessary. Even with high protective walls on both sides, ventilation and lighting present a problem.

PURPOSE OF THE INVENTION

The primary object of this invention is to provide a combination of a roadway and an assembly for protecting against noise emanating from the roadway wherein the disadvantages associated with the prior art are overcome in a relatively simple and certain manner.

SUMMARY OF THE INVENTION

The combination made in accordance with this invention includes walls fitted or disposed at right angles to a frame structure having dimensions of length and width. The frame structure is disposed around a roadway. The walls are laterally spaced with respect to each other across the width of the frame structure and form intervals therebetween. The walls and intervals are effective to guide the sound by controlled deflection. Therefore, objects situated in the vicinity of the roadway are protected to a considerable extent by deflection from the direct effect of the noise. The open configuration of the noise protecting assembly provides air and light to the roadway area from which the noise emanates.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DESCRIPTION OF SPECIFIC EMBODIMENTS

Figure 1:
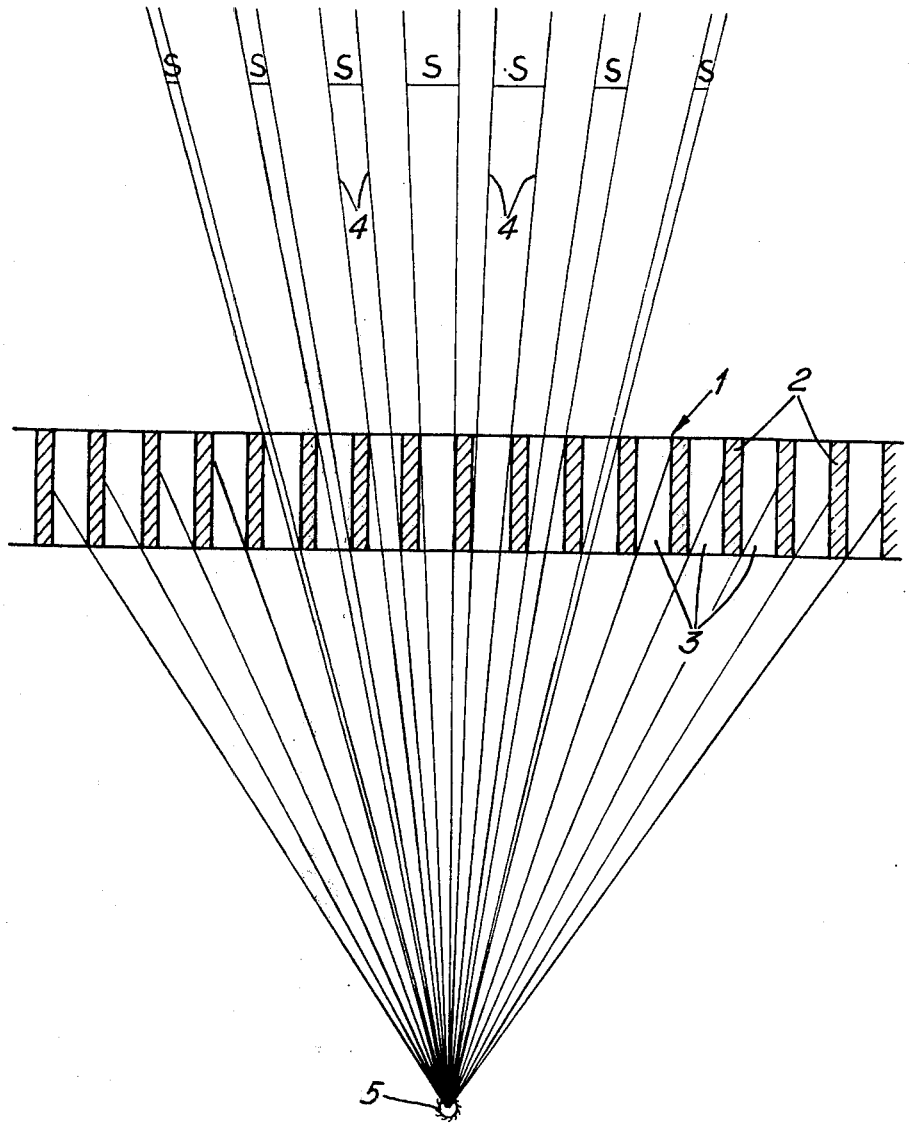
FIG. 1 is a sectional view through a first embodiment of a noise deflecting assembly made in accordance with this invention.

The assembly or combination, generally designated 1, as shown in FIG. 1 comprises a system of walls 2 which are arranged at suitable intervals with respect to each other. In this particular embodiment, the walls 2 are in the form of sheets that are disposed in parallel relationship with respect to each other. Spaces 3 shown between the sheets or walls 2 permit passage of air and light. To a limited extent, it is possible to see through the assembly 1. The sheets or walls 2 cause a deflection of sound emanating from a source 5 as shown by lines 4. The sheets or walls 2 restrict the direct line of sight through the assembly 1 and, in part, completely interrupt it thereby maintaining the lateral zones in the shadow of the sound.

The assembly 1 can be arranged sideways and/or above with respect to the noise source 5. That is, the assembly 1 may be a vertical, wall-like lateral lining or a horizontal covering resembling a flat roof. As a lining, the square dimensions of the system constitute the length and width of a frame structure that supports the walls 2. The length and width of the covering constitute the square dimensions of the system in the latter instance. The sound deflecting walls 2 are arranged at right angles to the square dimensions of the system, either vertically thereto or at an angle other than 90° that is an oblique angle. The interval between the walls or sheets 2 can be uniform or may vary.

The sound deflecting assembly 1 having intermediate spaces 3 differs significantly from assemblies in the known closed sound protection devices. FIG. 1 shows a section of a slatted assembly 1 having walls or sheets 2 disposed vertically with respect to the square dimension of the assembly. As shown, a portion of the sound can pass through the assembly only in a certain zone. The side zones are located completely within the sound shadow. The zones S represent the amount exposed to noise from the direct path of sound from source 5 and thus the amount of noise passing through the assembly. As shown, the total of the zones S is relatively small. If the slats or sheets 2 are made of sound absorbent material, the sound protective or deadening effect is especially great. The sheets 2 may be replaced by other structures as a tubular or honeycomb formation.

The combination of noise deflection and noise absorption has a particularly favorable effect in controlling noise pollution. This effect is even greater as the sound absorbing area facing the sound source increases. The assemblies can be completely or partially made of sound absorbing material. Where the efficiency or durability of sound absorbent materials can be affected by weather conditions, the sound absorbent materials may be protected by surface coatings or linings. It is necessary, however, that the surface protection be permeable to sound so that the sound may penetrate to the sound absorbent material and be absorbed by it.

The total sound absorbing area may be adjusted and adapted to the particular requirement by modifying the height of the walls 2 and the mutual interval therebetween. In addition to its noise deflecting and noise absorbing properties, the protective assembly of the present invention is also transparent. That is, air and light may pass therethrough and there is through visibility with respect to the wall structure or assembly. Such a protective device may be manufactured to provide a high degree of noise protection and moderate transparency or vice versa.

Figure 7:
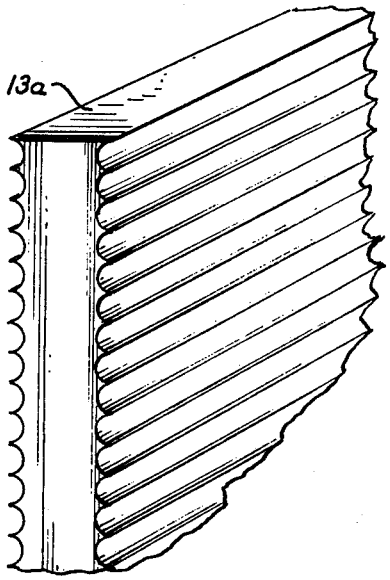
FIG. 7 is a fragmentary perspective view of an embodiment of an assembly member useful in the invention.

In every case, such protective assemblies present a total absorbing surface which is several times that of their square dimensions. The free spaces 3 between the walls 2 are equal to or considerably greater than the thickness of the walls 2. The surfaces of the walls 2 may have a special structure by making indentations or projections in them such as grooves thereby still further increasing the sound absorbent area as a whole. See FIG. 7.

The noise protection device of this invention can be used against noises of all kinds with the exception of aircraft noise from the sky. Used as a side assembly for roads or railroad tracks, through visibility is important. When looking through it approximately perpendicularly to the protective assembly, through visibility is the same as with railings. when used at shooting ranges, the possibility of entry of light is important. When used as a road covering, access for air and light is essential.

If lateral linings are erected along roads, the walls 2 may run either horizontally or vertically. Combined lateral linings may consist of solid sections and of sections with gaps in accordance with the invention. When used as a road covering, the width of tne walls 2 are in a vertical position and run mainly parallel with respect to the axis of the road. Thus, the much reduced noise which still escapes is deflected mainly upwardly. Consequently, it is possible to build high buildings directly on the road.

The height of the walls 2 and their mutual intervening gaps 3 are selected in such a way that even the upper floors of the buildings are not subjected to the direct impact of noise. This requirement is met when, viewed from the top of the building, there is no direct line of sight to the roadway over the upper edge of one wall and beneath the lower edge of the next adjacent wall. The height of the walls can be less or the spaces between them greater toward the middle of the road as compared with the side of the road. Preferential noise protection can be given to one side of the street with respect to the other by positioning the walls obliquely. The height, distance apart and inclination of the walls are arranged so that the effects of snow have no significantly adverse influence on the entry of air and light.

Figure 2:
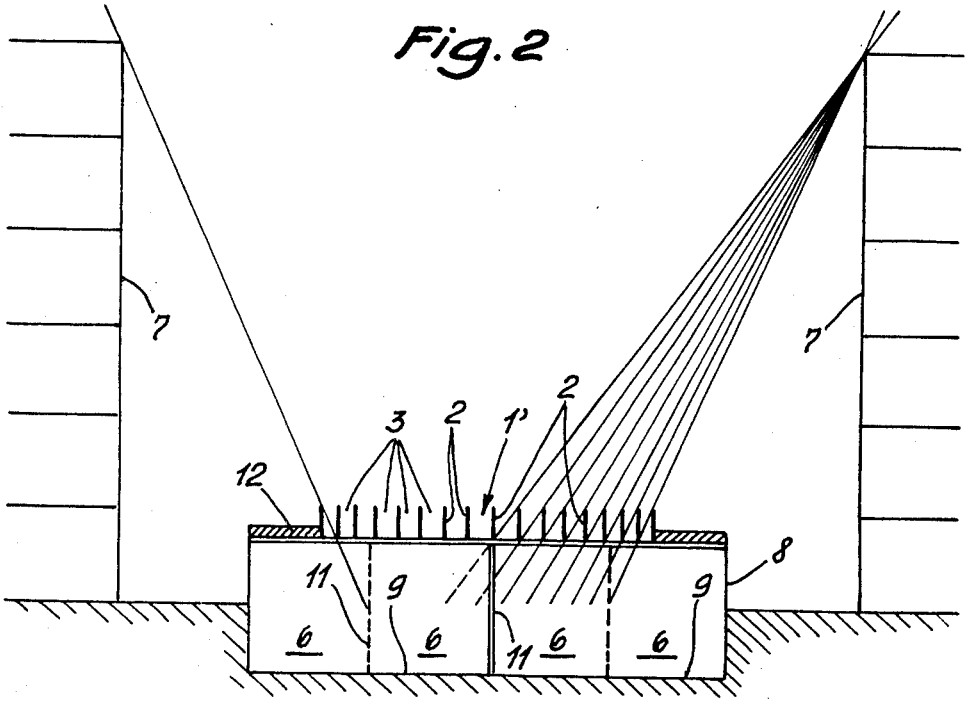
FIG. 2 is a diagrammatic sectional view of a second embodiment of a noise deflecting assembly made in accordance with this invention.

FIG. 2 is a diagrammatic representation of a system made in accordance with this invention used as a road covering. A partially sunken roadway 9 has four lanes equipped with continuous side walls 8. Buildings 7 are at a distance of four meters from the side wall 8 and are sixteen meters high. The assembly 1' has varying gaps or intervals 3 disposed between walls 2 which run longitudinally with respect to the road 9. The assembly 1' includes transverse support 10 that runs across the road and is carried by columns 11. The transverse support 10, columns 11 and side walls 8 constitute a frame structure disposed around the roadway and having dimensions of length and width. Because of the shape, position and arrangement of the walls 2, only a limited amount of snow and wind pressure on the assembly needs to be taken into consideration when designing the components 11 which form a bearing structure. As is evident from the drawings, the walls 2 project outwardly from the frame structure.

The covering of this invention does not need to extend over the entire road 9. A portion of the width and/or the length can be roofed with solid material to provide pedestrian walkways 12 along or across the road. Such solid portions along the cover may be used for other purposes.

If the building adjacent the roadway is not very tall, then a complete covering is not required. A side wall jutting out to an adequate height over the road with a partial covering may be installed to effect the necessary noise protection system.

While fiber base materials exert a good, sound deadening effect by the absorption of noise, it is difficult to process such mineral fiber into walls 2 because of their low strength. The individual walls 2 must be fitted in such a way that they can stand up to stress exerted during transport, assembly and the period of use without losing their shape. It follows that a special method of securing is required for walls made of materials of low strength such as mineral fibers. Good results have been obtained by using a supporting framework consisting of parallel components reinforced if necessary by cross braces.

Figure 3:
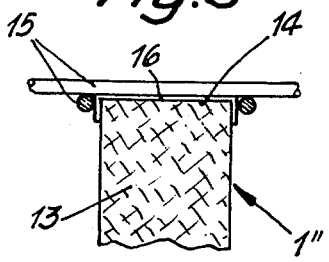
FIG. 3 is a detailed sectional view of another embodiment of a sound deflecting assembly formed of inserted sheets.
Figure 5:
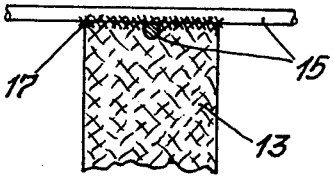
FIG. 5 is a cross-sectional view of a further embodiment of a noise deflecting assembly made in accordance with this invention.
Figure 4:
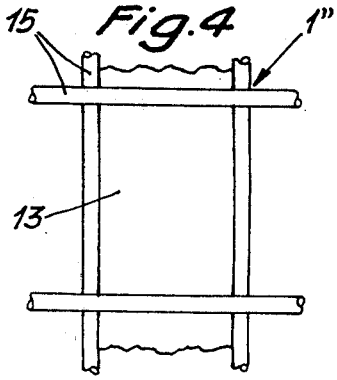
FIG. 4 is a top plan view of the assembly shown in FIG. 3.
Figure 6:
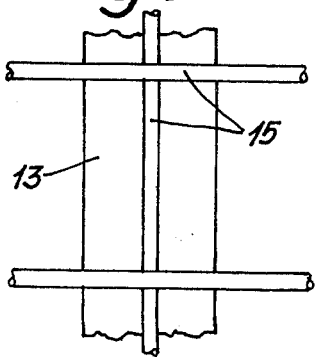
FIG. 6 is a top plan view of the variation shown in FIG. 5.

Another embodiment of a slatted structure useful in a noise protection assembly made in accordance with this invention is shown in FIG. 3. Walls 13 are gripped at their end faces 14 by the lattice wires 15. Walls 13 may be gripped either laterally as shown in FIGS. 3 or 4 or centrally as shown in FIGS. 5 and 6.

The insertion of several walls 13 into the lattice produces the noise-deflecting wall 1''. The lattice mounting encloses the walls 13 either wholly or partially. When completely enclosed, the lattice is in the form of a closed basket and at the same time provides protection against external stresses on the walls 13.

The end faces of the walls 13 are the most exposed parts thereof. These may be given extra protection against the weather by being coated with a layer 16 as shown in FIG. 3 or provided with a surface coating 17 as shown in FIG. 5. A U-shaped section, not separately illustrated, may be used as an equivalent to the layer 16 or coating 17.

Figure 8:
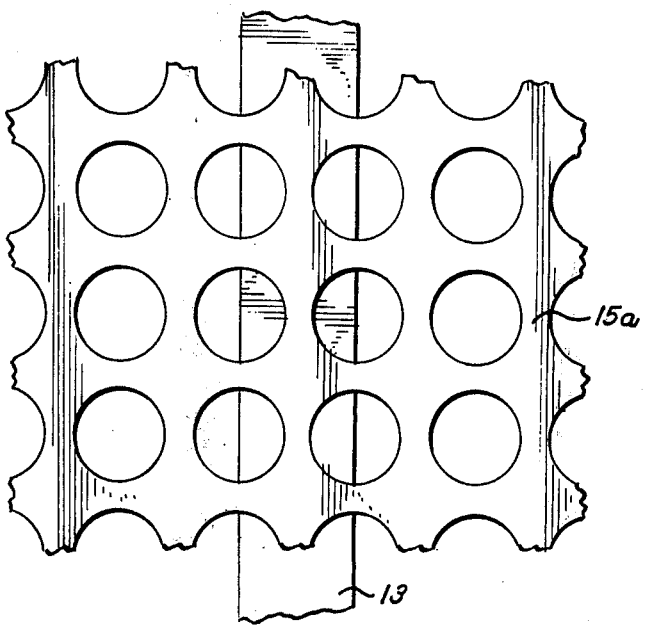
FIG. 8 is a fragmentary top plan view of a further embodiment of the invention.

The surface coating 17 may include adhesive material so that there is an adhesive connecting joint between the end face of the walls 13 and the lattice wire 15. An alternative to the lattice wire framework is a metal sheet having holes disposed therein. Such holes or perforations may be in the shape of either slits or circles. See FIG. 8.

The components constructed as shown in either FIGS. 3 or 4 are constructed with dimensions of for example 1 meter by 1 meter by the width of the walls. Components are assembled on the site of the proposed noise-proofing to produce a sound-deflecting assembly. Such noise reducing assemblies are suitable both for street coverings and for lining roads on one or both sides thereof. Protective assemblies may be formed along railway tracks and may be made to control noise from shooting, sports, industry and construction.

There are several advantages associated with using a slatted structure of the present invention as compared with unbroken assemblies. These advantages include permeability to air, light and vision and smaller dimensioning of the supporting structure in consequence of reduced snow and wind pressure.

An advantage of the assembly is that the lattice structures as shown may be used to form solid, unbroken noise protection units. These can be combined with noise-deflecting units to form a protective system.

The prismatic construction elements of this assembly have a marked degree of stability against the effects of external pressure when adequate thickness of the lattice wires 15 and a suitable mesh size of the gridded lattice are used. It is possible to construct an entire system providing noise protection without any additional supporting structure. All that is required is bracing against lateral forces.

While the assembly for protection against noise has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. The combination comprising:
a. a roadway adapted for motor vehicular traffic and extending along the surface of the ground, and
b. a noise protecting assembly for controlling sound emanating from the roadway,
c. said noise protecting assembly including a frame structure and a plurality of walls consisting at least partially of sound absorbent material,
d. said frame structure having dimensions of length and width and including a portion disposed above the roadway,
e. said walls having a width disposed vertically above the roadway,
f. said walls having a length disposed in a direction parallel to the centerline of the roadway and being laterally spaced with respect to each other across the width of the frame structure thereby forming intervals therebetween,
g. said walls and intervals being effective to prevent the direct path of sound from a source of noise on the roadway to objects in the vicinity of the roadway,
h. said intervals being between the walls and allowing the passage of air and light to the roadway.

2. The combination as defined in claim 1 wherein the walls project outwardly from the frame structure.

3. The combination as defined in claim 1 wherein the intervals are uniform in width between said walls that are laterally disposed across the assembly.

4. The combination as defined in claim 1 wherein the intervals vary in width between said walls that are laterally disposed across the assembly.

5. The combination as defined in claim 1 wherein the roadway is sunken below the established level of the ground.

6. The combination as defined in claim 1 wherein the sound-absorbent walls are provided with a surface protection against the effects of the weather which allows the passage of sound.

7. The combination as defined in claim 1 wherein the walls are elongated elements extending along the frame structure.

8. The combination as defined in claim 1 wherein said walls consist of slats having a long, thin structural configuration.

9. The combination as defined in claim 1 wherein the sound-absorbent materials include surfaces having a structural means which enlarges the total surface area.

10. The combination as defined in claim 1 wherein each said wall includes a surface consisting of sound-absorbent materials.

11. The combination as defined in claim 1 wherein said walls consist entirely of sound-absorbent materials.

12. The combination as defined in claim 1 wherein the frame structure includes a wall mounting supporting frame to which the walls are secured.

13. The combination as defined in claim 12 wherein the wall mounting supporting frame includes a grid structure.

14. The combination as defined in claim 12 wherein the wall mounting supporting frame is formed of perforated sheets.

15. The combination as defined in claim 12 wherein the wall mounting supporting frame is formed of lattices.

16. The combination as defined in claim 12 wherein the wall mounting supporting frame consists of a structure with parallel components.

17. The combination as defined in claim 16 wherein said walls include a protective lining along the end faces thereof and contiguous to said parallel components.

18. The combination as defined in claim 16 wherein said walls include a protective coating along the end faces thereof and
said walls are held by the parallel components.

* * * * *